United States Patent [19]

Olan

[11] 4,165,124

[45] Aug. 21, 1979

[54] COMBINATION OF CHAIR AND APPAREL CABINETS

[76] Inventor: Jose A. Olan, La Quinta K-15 St. #5, Yauco, P.R. 00768

[21] Appl. No.: 906,043

[22] Filed: May 15, 1978

[51] Int. Cl.[2] ..... A47C 7/62

[52] U.S. Cl. ..... 297/190; 297/194; 297/430

[58] Field of Search ..... 297/217, 190, 192, 193, 297/188, 430; 312/235 R; 5/58

[56] References Cited

U.S. PATENT DOCUMENTS

| | | | |
|---|---|---|---|
| 520,284 | 5/1894 | Wonson et al. | 297/192 X |
| 967,452 | 8/1910 | Silverman | 312/235 R |
| 1,403,543 | 1/1922 | Daniel | 312/235 R |
| 2,229,937 | 1/1941 | Reese | 312/235 R |
| 2,547,547 | 4/1951 | Tatar | 312/235 R |
| 2,563,436 | 8/1951 | Toth | 312/235 R |
| 2,563,564 | 8/1951 | Thomas | 5/58 |
| 3,136,578 | 6/1964 | Tihovici | 297/194 |

FOREIGN PATENT DOCUMENTS

| | | | |
|---|---|---|---|
| 918753 | 11/1946 | France | 297/194 |
| 1076504 | 4/1954 | France | 297/194 |

*Primary Examiner*—James T. McCall
*Attorney, Agent, or Firm*—Daniel Jay Tick

[57] ABSTRACT

A chair has a footrest slidably mounted beneath its seat. An apparel container is slidably mounted on the chair frame beneath the footrest and is movable to an extended position for exposing the container to access by a user. A first apparel cabinet extends along one side of the chair and is positioned perpendicularly to the seat and back rest thereof. A second apparel cabinet extends along the opposite side of the chair and is positioned perpendicularly to the seat and back rest thereof in parallel relation with the first cabinet. At least one of the cabinets has a height dimension sufficient to form an arm of the chair.

4 Claims, 4 Drawing Figures

COMBINATION OF CHAIR AND APPAREL CABINETS

BACKGROUND OF THE INVENTION

The present invention relates to a combination of chair and apparel cabinets.

Combination chair and apparel cabinets are disclosed in U.S. Pat. Nos. 879,803; 960,360; 2,613,735; 2,692,007; 2,696,418 and 3,093,412.

Objects of the invention are to provide a combination of chair and apparel cabinets of simple structure, which is inexpensive in manufacture, and provides complete comfort for a person dressing and especially putting on shoes, by providing a comfortable chair for the person to sit in and a wide selection of inner footwear and outer footwear, as well as other items of clothing, at the fingertips of the user.

BRIEF DESCRIPTION OF THE DRAWINGS

In order that the invention may be readily carried into effect, it will now be described with reference to the accompanying drawings, wherein.

DETAILED DESCRIPTION OF THE INVENTION

The combination of chair and apparel cabinets of the invention comprises a chair having a frame 1 (FIG. 3), a seat 2 (FIGS. 1 to 4) supported by the frame and a plurality of legs supported by the frame at a distance above a floor, and a back rest 3 (FIGS. 1 to 4) supported by the frame and extending substantially upright behind the seat.

Figure 2:
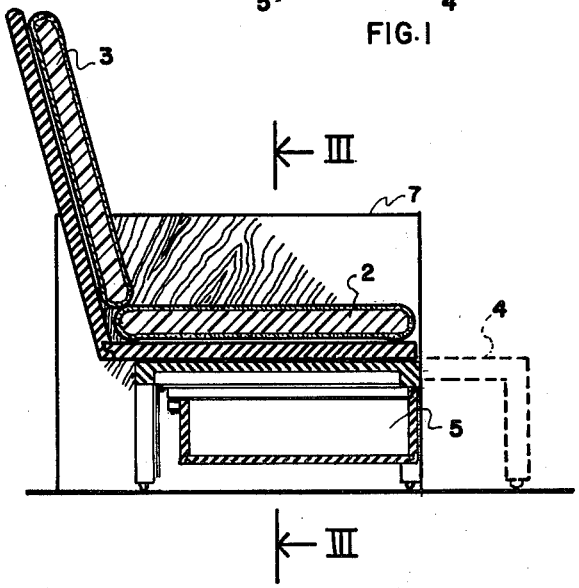
FIG. 2 is a side view of the embodiment of FIG. 1.

The combination of the invention comprises a footrest 4 slidably mounted on the chair frame 1 beneath the seat 2 for movement to a stored position under said seat, as shown by solid lines in the FIGS. and to an extended position, as shown by broken lines in FIG. 2, for supporting the feet of a person seated on the chair.

Figure 1:
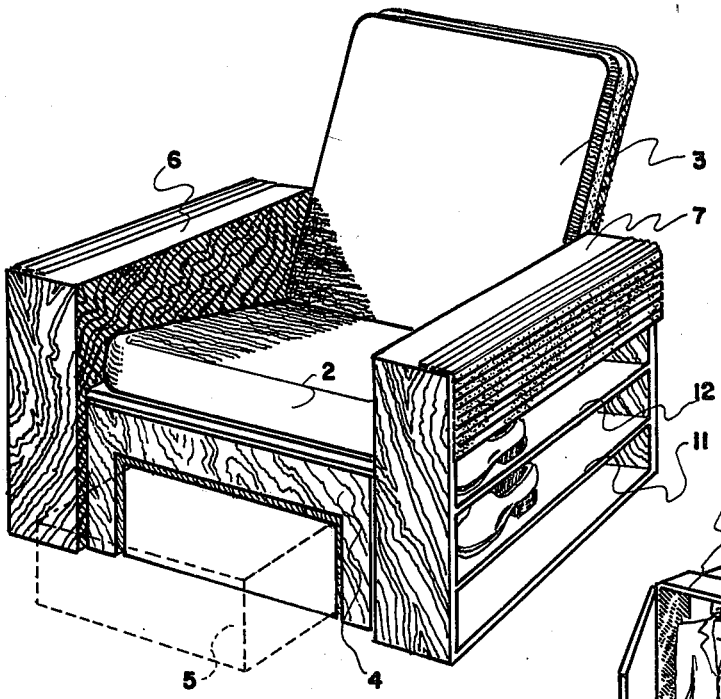
FIG. 1 is a perspective view of an embodiment of the combination of chair and apparel cabinets of the invention.

An apparel container 5 is slidably mounted on the chair frame 1 beneath the footrest 4 for movement to a stored position under the footrest 4 and the seat 2, as shown by solid lines in the FIGS., and to an extended position, as shown by broken lines in FIG. 1, for exposing said container to access by a user. The apparel container 5 thus functions as a drawer and stores inner footwear such as socks, stockings and the like, as well as other desired items of apparel.

Figure 4:
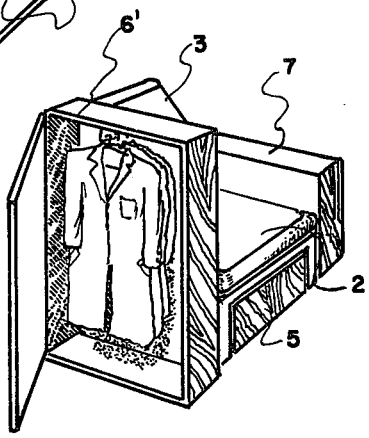
FIG. 4 is a perspective view, on a reduced scale, of another embodiment of the combination of chair and apparel cabinets of the invention.
Figure 3:
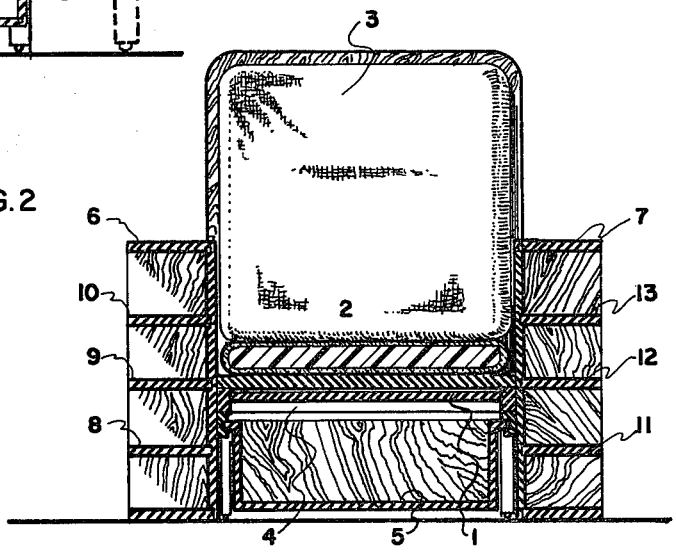
FIG. 3 is a cross-sectional view, taken along the lines III—III, of FIG. 2.

A first apparel cabinet 6 (FIGS. 1 and 3) or 6′ (FIG. 4) extends along the right side of the chair and is positioned substantially perpendicularly to the seat 2 and the back rest 3 of said chair, as shown in FIGS. 1, 3 and 4. The first apparel cabinet 6 or 6′ is preferably affixed to the frame 1 of the chair, although it may be freestanding.

A second apparel cabinet 7 extends along the left side of the chair and is positioned substantially perpendicularly to the seat 2 and the back rest 3 thereof in substantially parallel relation with the first apparel cabinet 6, as shown in FIGS. 1 to 4. The second apparel cabinet 7 is preferably affixed to the frame 1 of the chair, although it may be freestanding.

In the embodiment of FIGS. 1 to 3, both apparel cabinets 6 and 7 have the same height dimension, which dimension is sufficient to form an arm of the chair, so that the tops of said cabinets function as arm rests.

In the embodiment of FIG. 4, the first cabinet 6′ has a greater height dimension than the second cabinet 7 and is utilized to store outer garments such as, for example, jackets, trousers, slacks, dresses, blouses, skirts, shirts, and the like.

Each of the first and second cabinets 6 and 7, respectively, has a plurality of shelves therein for storing outer footwear such as, for example, shoes, boots, and the like. Thus, as shown in FIG. 3, the first cabinet 6 has a plurality of shelves 8, 9 and 10 and the second cabinet 7 has a plurality of shelves 11, 12 and 13.

A user of the chair thus has a complete valet service at his or her fingertips, since his or her entire wardrobe is encompassed in the chair itself. The user need merely make himself or herself comfortable seated in the chair, select an item of apparel, and put it on in comfort and leisure.

While the invention has been described by means of specific examples and in specific embodiments, I do not wish to be limited thereto, for obvious modifications will occur to those skilled in the art without departing from the spirit and scope of the invention.

I claim:

1. A combination of chair and apparel cabinets, comprising a chair having a frame, an upholstered seat supported by the frame at a distance above a floor and an upholstered back rest supported by the frame in fixed position and extending substantially upright behind the seat;

a footrest slidably mounted on the chair frame beneath the seat for movement to a stored position under the seat and to an extended position for supporting the feet of a person seated in the chair;

an apparel container slidably mounted on the chair frame beneath the footrest for movement to a stored position under the footrest and the seat and to an extended position for exposing said container to access by a user;

a first apparel cabinet extending along one side of the chair and positioned substantially perpendicularly to the seat and back rest thereof; and a second apparel cabinet extending along the opposite side of the chair and positioned substantially perpendicularly to the seat and back rest thereof in substantially parallel relation with said first apparel cabinet, at least one of said first and second apparel cabinets having a height dimension sufficient to form an arm of the chair, each of said first and second cabinets having a back panel abutting said seat and back rest, a front side panel extending to a height at least equal to that of an arm of the chair, a back side panel equal in height to the front side panel in spaced parallel relation with the front side panel and a substantially horizontal top panel.

2. A combination as claimed in claim 1, wherein at least one of the first and second cabinets has a plurality of shelves therein for storing outer footwear and said apparel container stores inner footwear.

3. A combination as claimed in claim 1, wherein at least one of the first and second cabinets has a greater height dimension than the other and stores outer garments.

4. A combination as claimed in claim 1, wherein both cabinets have the same dimensions and function as arms of the chair, each of the cabinets having a plurality of shelves therein for storing outer footwear.

* * * * *